US010176942B2

(12) United States Patent
Han et al.

(10) Patent No.: US 10,176,942 B2
(45) Date of Patent: Jan. 8, 2019

(54) LIFTABLE KEYBOARD

(71) Applicant: Microjet Technology Co., Ltd., Hsinchu (TW)

(72) Inventors: Yung-Lung Han, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 0 days.

(21) Appl. No.: 15/795,966

(22) Filed: Oct. 27, 2017

(65) Prior Publication Data

US 2018/0122599 A1 May 3, 2018

(30) Foreign Application Priority Data

Oct. 28, 2016 (TW) ..... 105134948 A

(51) Int. Cl.

| | |
|---|---|
| ***H01H 13/82*** | (2006.01) |
| ***H01H 13/84*** | (2006.01) |
| ***H01H 13/86*** | (2006.01) |
| ***H01H 13/705*** | (2006.01) |

(52) U.S. Cl.

CPC ..... *H01H 13/84* (2013.01); *H01H 13/705* (2013.01); *H01H 13/82* (2013.01); *H01H 13/86* (2013.01); *H01H 2213/002* (2013.01); *H01H 2223/052* (2013.01); *H01H 2231/002* (2013.01)

(58) Field of Classification Search

CPC ..... H01H 13/82; H01H 13/86; H01H 13/702; H01H 13/7065; H01H 2213/002; H01H 2223/052; H01H 2223/062

See application file for complete search history.

(56) References Cited

U.S. PATENT DOCUMENTS

| | | | | |
|---|---|---|---|---|
| 8,928,621 | B2 * | 1/2015 | Ciesla | G06F 3/0202 345/174 |
| 9,612,659 | B2 * | 4/2017 | Ciesla | G06F 3/04886 |
| 10,109,436 | B2 * | 10/2018 | Wang | G06F 1/1616 |
| 2011/0226597 | A1 * | 9/2011 | Siddeeq | H01H 13/702 200/329 |
| 2018/0122595 | A1 * | 5/2018 | Han | H01H 13/14 |

* cited by examiner

*Primary Examiner* — Felix O Figueroa

(74) *Attorney, Agent, or Firm* — Kirton McConkie; Evan R. Witt

(57) ABSTRACT

A liftable keyboard for a portable electronic device is provided. The portable electronic device includes a top cover and a base. The liftable keyboard includes a key unit, a membrane switch circuit layer, a vent valve and a pump. The key unit includes a keycap and an elastomer. The vent valve includes an inlet, an outlet and a gas exhaust chamber. The inlet and the outlet are in communication with a gas-inputting port and a gas-outputting port of the membrane switch circuit layer, respectively. The gas exhaust chamber is in communication with the pump. When a sensing element of the base senses that the top cover is close to the base, the pump is enabled to perform a gas-extracting action. The elastomer is subjected to compressed deformation and the keycap is moved downwardly. Consequently, an altitude of the key unit is reduced.

6 Claims, 5 Drawing Sheets

LIFTABLE KEYBOARD

FIELD OF THE INVENTION

The present invention relates to a keyboard, and more particularly to a liftable keyboard with a vent valve and a pump.

BACKGROUND OF THE INVENTION

In today's information generation, the computer has become an indispensable electronic information product in everyone's life. The peripheral input device of the computer includes a mouse, a keyboard, a writing board, or the like. Amongst those devices, the keyboard plays an irreplaceable role because it allows user to rapidly input characters and symbols into the computer, and allows user to edit plural document files at the same time.

FIG. 1 is a schematic perspective view illustrating the appearance of a conventional keyboard. The conventional keyboard 1 is used for being built in a laptop, and consists of a base portion 11 and plural keys 10. The arrangement of the keys 10 is determined according to the design of the manufacturer. When any of the keys 10 is pressed by user's finger, a corresponding character, symbol or number is entered.

FIG. 2 is a schematic cross-sectional view illustrating a conventional keyboard. As shown in FIG. 2, the keyboard 1 comprises the base portion 11 and the plural keys 10. Each key 10 comprises a keycap 101, a scissor connecting element 102 and an elastomer 103 aligned with the keycap 101. The scissor connecting element 102 is connected to the keycap 101, and also connected to the elastomer 103. The base portion 11 comprises a membrane switch circuit 12, plural spacing structures 13, a supporting plate 14 and a lower casing 15. The membrane switch circuit 12 comprises an upper wiring board 121, a separation layer 122 and a lower wiring board 123, all of which are made of a light-transmissible material. The membrane switch circuit 12 further comprises plural key switches 124, each of which corresponds to a key 10 and is configured to be aligned with the center of the elastomer 103 of the corresponding key 10. Once the keycap 101 of any one of the keys 10 is pressed down, the two interlock pieces of the scissor connecting element 102 swings and depresses the elastomer 103, therefore triggering the corresponding key switch 124 disposed on the membrane switch circuit 12. Consequently, the triggered key switch 124 generates output signals.

Please refer to FIG. 2 again. The supporting plate 14 is located under the membrane switch circuit 12 for supporting it. The lower casing 15 wraps the supporting plate 14 and the membrane switch circuit 12 for protecting them. The plural spacing structures 13 are disposed on the membrane switch circuit 12, each of which is arranged between every two adjacent keys 10. An accommodation space 131 is consequently formed between each two adjacent spacing structures 13 for receiving the scissor connecting element 102 and the elastomer 103 of each key 10. The keycap 101 of the key 10 is supported by the scissor connecting element 102 and the elastomer 103, therefore having an altitude higher than the altitude of the spacing structure 13. When the keycap 101 is pressed down, the two interlock pieces of the scissor connecting element 102 swings and the elastomer 103 is subjected to downward deformation to trigger the key switch 124. Under this circumstance, the altitude of the keycap 101 is lowered in response to the pressing force of the user, sinking into the accommodation space 131. However, when the keycap 101 is no longer pressed by the user, the elastomer 103 is subjected to upward deformation in response to the elastic force of itself, and the keycap 101 is returned to its original position. Meanwhile, the scissor connecting element 102 also goes back to its initial state and supports the keycap 101 as a level higher than the spacing structure 13, protruding out from the accommodation space 131.

Nowadays, the trends of designing electronic devices are toward small size, light weightiness and easy portability. Above-mentioned structure of the conventional keyboard 1 has a fixed height, so it is difficult to reduce the altitude of the overall keyboard 1 and the product with the conventional keyboard 1 is heavy and large.

Therefore, there is a need of providing an improved low-profile keyboard in order to overcome the drawbacks of the conventional technologies.

SUMMARY OF THE INVENTION

An object of the present invention provides a liftable keyboard able to extract the gas in the elastomers of plural key units simultaneously so as to descend the plural key units and maintain their low profile. Consequently, the portable electronic device which applies the liftable keyboard can have lessened overall thickness. In other words, the portable electronic device has the benefits of small size, light weightiness and easy portability.

In accordance with an aspect of the present invention, there is provided a liftable keyboard for use with a portable electronic device. The portable electronic device includes a top cover and a base. The liftable keyboard includes plural key units, a membrane switch circuit layer, plural vent valves and a pump. Each key unit includes a keycap and an elastomer aligned with the keycap. The membrane switch circuit layer includes at least one gas-inputting port and at least one gas-outputting port. Each gas-inputting port is aligned with the elastomer of the corresponding key unit. The vent valves are located under the membrane switch circuit layer, each of which is aligned with the corresponding key unit, and includes an inlet, an outlet and a gas exhaust chamber. The inlet of the vent valve is in communication with the corresponding gas-inputting port of the membrane switch circuit layer. The outlet is in communication with the corresponding gas-outputting port of the membrane switch circuit layer. The pump is in communication with the gas exhaust chambers of the vent valves which are in communication with each other. When the sensing element within the base of the portable electronic device senses that the top cover is close to the base, the pump is enabled to apply suction to the gas exhaust chambers of the vent valves such that a gas in the elastomer of each key unit is extracted to the vent valve, sequentially passing through the corresponding gas-inputting port of the membrane switch circuit layer and the inlet of the corresponding vent valve. After that, the gas is outputted from the outlet of the corresponding vent valve and discharged from corresponding gas-outputting port of the membrane switch circuit layer. Consequently, the elastomer of each key unit is subjected to compressed deformation and the keycap of the corresponding key unit is moved downwardly in response to the compressed deformation of the elastomer, so that an altitude of the corresponding key unit is reduced.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
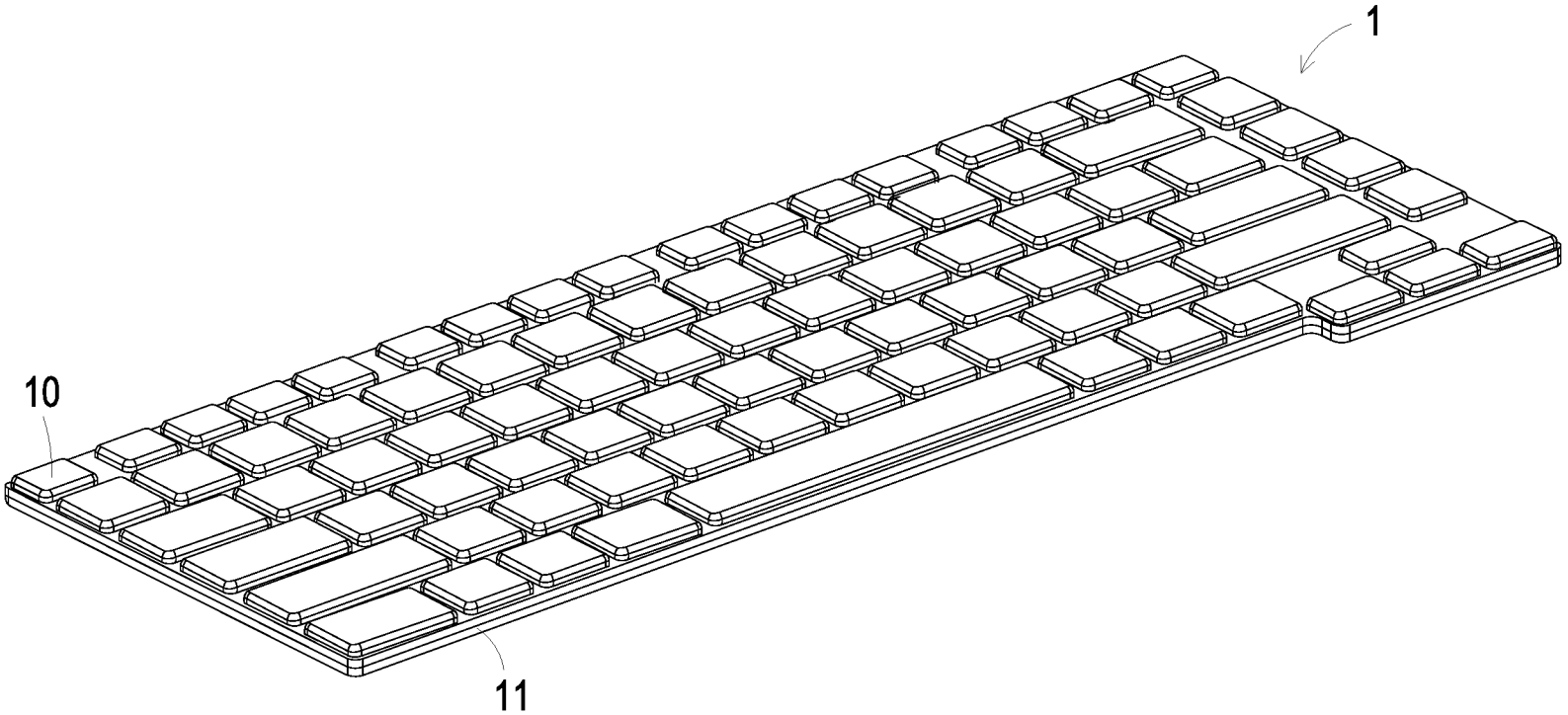
FIG. 1 (PRIOR ART)
FIG. 1 is a schematic perspective view illustrating the appearance of a conventional keyboard.
Figure 2:
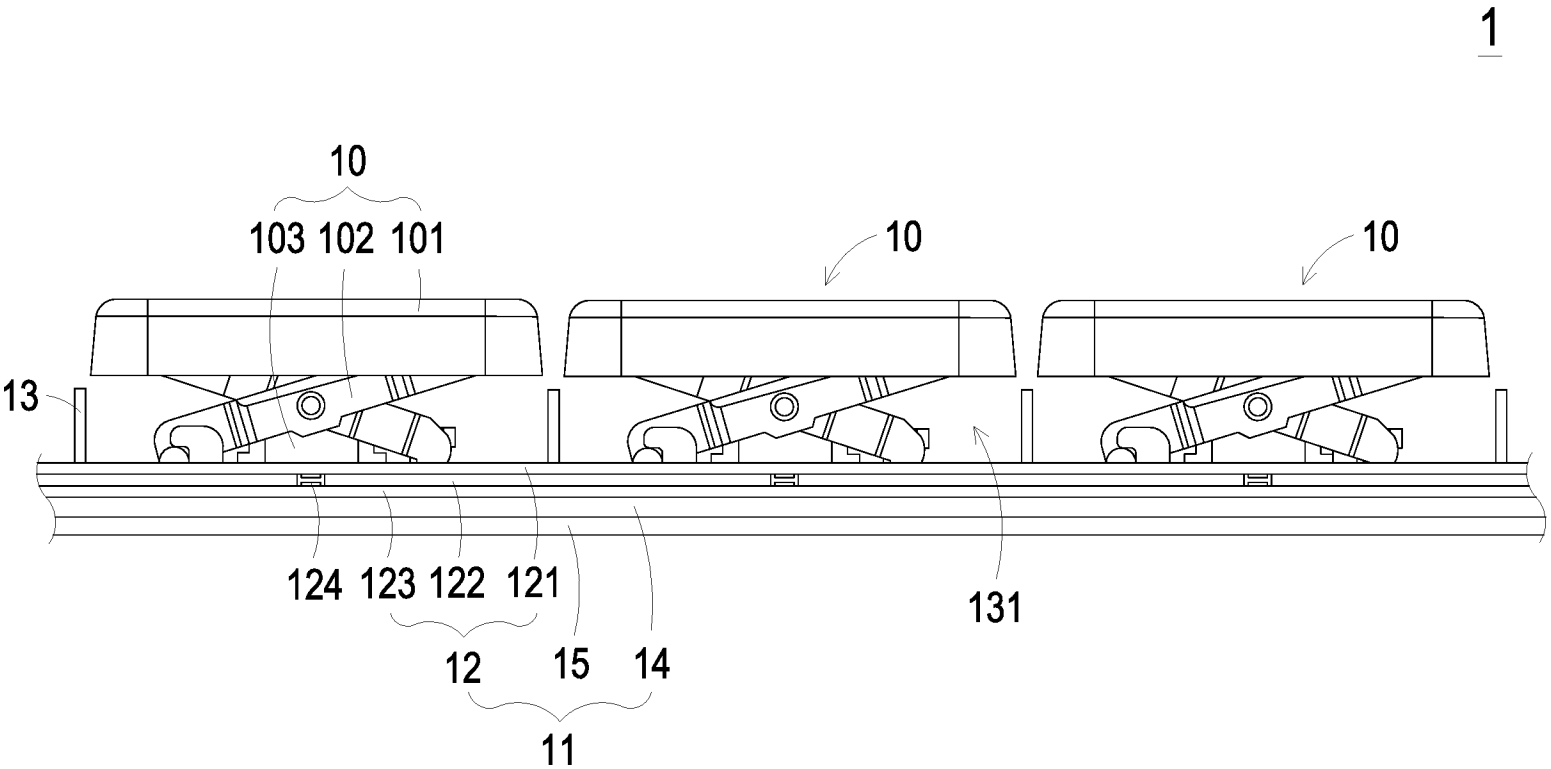
FIG. 2 (PRIOR ART)
FIG. 2 is a schematic cross-sectional view illustrating a conventional keyboard.
Figure 3:
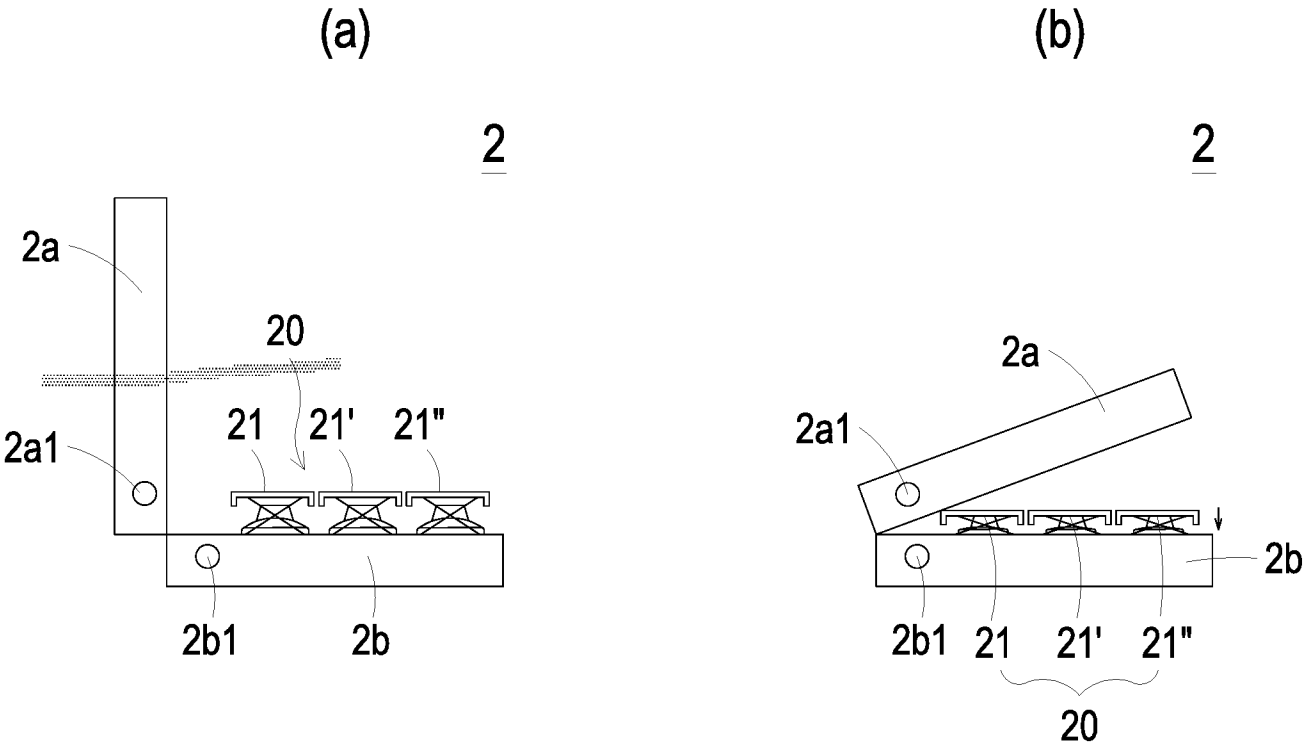
FIG. 3 is a schematic view illustrating the concepts of ascending and descending the key units of a liftable keyboard of the present invention.

FIG. 3 is a schematic view illustrating the concepts of ascending and descending a liftable keyboard of the present invention. The liftable keyboard 20 is built in a portable electric device 2, e.g. laptop, handheld device, mobile phone, or the like that is portable and constructed to include a CPU, RAM, and others. In this embodiment, the portable electronic device 2 is a laptop having a top cover 2*a* and a base 2*b*. The base 2*b* is a box structure that accommodates the liftable keyboard 20, and the top cover 2*a* is operable to cover the base 2*b* for sheltering the liftable keyboard 20 as well as relative electronic components. Such structure makes the portable electronic device 2 easy to carry. The liftable keyboard 20 comprises plural key units, for succinctness, only three key units 21, 21' and 21" are shown in the drawings. It is noted that the number and arrangement of the key units may be varied according to the practical requirements.

In some embodiments, a sensing element 2*b*1 is installed in the base 2*b*. An example of the sensing element 2*b*1 includes but is not limited to an electromagnetic sensor or an optical sensor. The sensing element 2*b*1 is used for detecting whether the top cover 2*b* is near the base 2*b* to cover the base 2*b*. In case that the sensing element 2*b*1 is the magnetic sensor, the top cover 2*a* is correspondingly equipped with a magnetic element 2*a*1 (e.g., a Hall sensor). As shown in FIG. 3, the sensing element 2*b*1 within the base 2*b* is able to detect the magnetic element 2*a*1 within the top cover 2*a*, when they are in a specified sensible distance. In the state (a), the base 2*b* is not covered by the top cover 2*a*, and the distance of the magnetic element 2*a*1 from the sensing element 2*b*1 is larger than the sensible distance. As a result, the magnetic element 2*a*1 cannot be sensed by the sensing element 2*b*1, and the sensing element 2*b*1 does not generate any sensing signal.

When the top cover 2*a* rotates about the base 2*b* to cover it, the magnetic element 2*a*1 is approaching to the sensing element 2*b*1. At the moment that the distance from the sensing element 2*b*1 to the magnetic element 2*a*1 is equal to or shorter than the sensible distance, which means they are closed enough, the magnetic element 2*a*1 is sensed by the sensing element 2*b*1. Consequently, the sensing element 2*b*1 generates an electromagnetic signal to enable a pump 24 (see FIG. 4A) to perform a gas-extracting action that descends the keys 21, 21' and 21" of the liftable keyboard 20. As depicted in the state (b), since the altitude of the liftable keyboard 20 has reduced and maintained, the portable electronic device 2 can be designed to have lessened overall thickness. As a result, the portable electronic device 2 has the benefits of small size, light weightiness and easy portability.

Figure 4A:
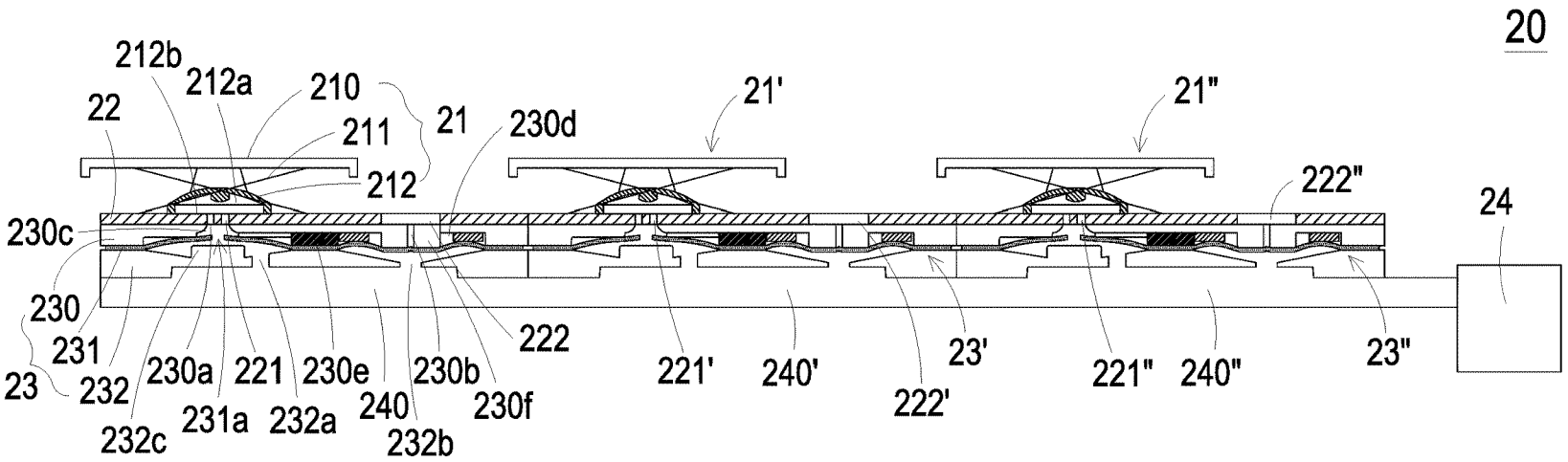
FIG. 4A is a schematic cross-sectional view illustrating plural key units and plural vent valves of the liftable keyboard according to an embodiment of the present invention.

FIG. 4A is a schematic cross-sectional view illustrating plural key units and plural vent valves of the liftable keyboard according to an embodiment of the present invention. In this embodiment, the liftable keyboard 20 comprises plural key units 21, 21' and 21", a membrane switch circuit layer 22, plural vent valves 23, 23' and 23", and a pump 24, all of which are disposed within the base 2*b* of the portable electronic device 2. In this embodiment, the plural key units 21, 21' and 21" are arranged in an array. It is noted that the number and arrangement of the key units may be varied according to the practical requirements.

As shown in FIG. 4A, the membrane switch circuit layer 22 has plural gas-inputting ports 221, 221' and 221", each of which is aligned with a corresponding key unit. Also, each of the vent valves 23, 23' and 23" is aligned with a corresponding key unit, and disposed under the membrane switch circuit layer 22. For example, the gas-inputting ports 221 and the vent valve 23 are adapted to correspond to the key unit 21 and aligned with it. The configuration regarding other key units 21' and 21" is similar. The pump 24 is in communication with all of the vent valves 23, 23' and 23" in series.

For succinctness, only the key unit 21, the membrane switch circuit layer 22 and the vent valve 23 will be described as follows. The other key units 21' and 22", and the other vent valves 23' and 23", also have constituted modular components that are similar to the key unit 21 and the vent valve 23.

As shown in FIG. 4A, the key unit 21 comprises a keycap 210, a scissor connecting element 211 and an elastomer 212. The keycap 210 has an inverted U-shaped structure. Preferably but not exclusively, the keycap 210 is made of a plastic material. The scissor connecting element 211 is connected to the keycap 210, and is also connected to the elastomer 212. The scissor connecting element 211 is adapted to support and move the keycap 210. The elastomer 212 is disposed under the keycap 210, not necessary to be in contact with the keycap 210 in an initial state, but can also be designed to contact the keycap 210 if there is any practical requirement. The elastomer 212 is a dome made of an elastic material such as rubber having an elastomeric chamber 212*a* with an opening 212*b* at its bottom. When the gas in the elastomeric chamber 212*a* is extracted, the elastomer 212 is subjected to the compressed deformation such that the scissor connecting element 211 drives keycap 210 to move downwardly. Thus, the altitude of the key unit 21 is reduced.

Figure 4B:
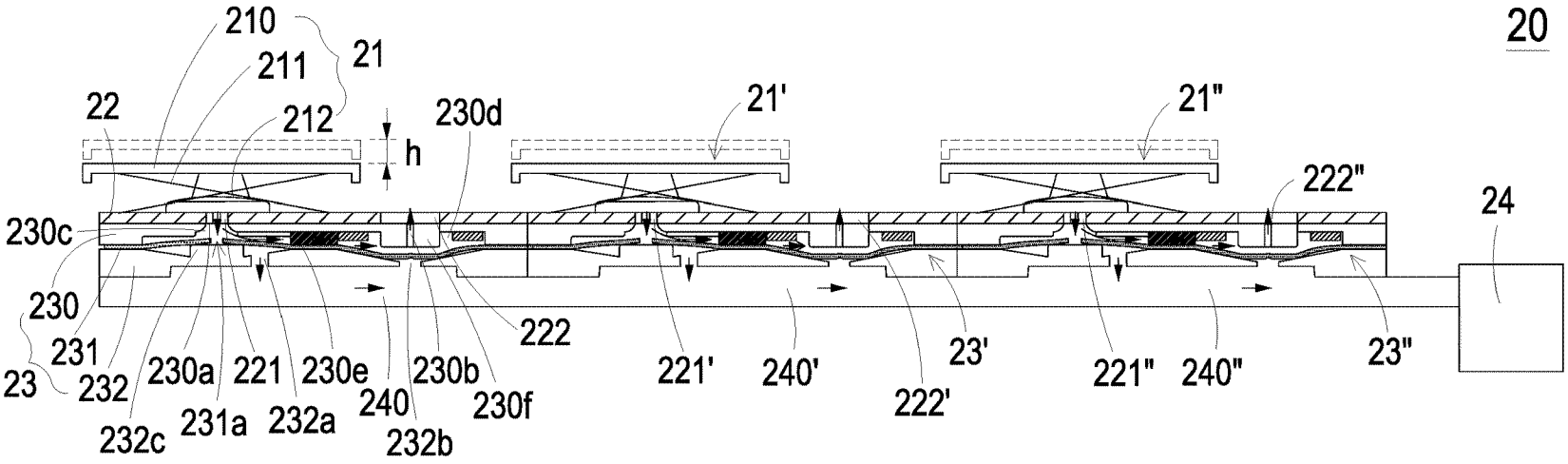
FIG. 4B is a schematic cross-sectional view illustrating the liftable keyboard of FIG. 4A and the concepts of ascending and descending the liftable keyboard.

FIG. 4B is a schematic cross-sectional view illustrating the liftable keyboard of FIG. 4A and the concepts of ascending and descending the liftable keyboard. Please refer to FIGS. 3, 4A and 4B.

As shown in FIG. 4A, the membrane switch circuit layer 22 is located between the key unit 21 and the vent valve 23. Meanwhile, the key unit 21, the gas-inputting port 221 and the vent valve 23 are aligned with and corresponding to each other to become a modular component, as mentioned above. Moreover, the membrane switch circuit layer 22 further comprises plural gas-outputting ports 222, 222' and 222", wherein the gas-outputting ports 222 is corresponding to the key unit 21 and joins the modular components regarding the key unit 21. Preferably but not exclusively, the gas-inputting port 221 is a ring-shaped hole, and aligned with the opening 212*b* of the elastomeric chamber 212*a* of the elastomer 212. Consequently, the gas-inputting port 221 is in communication with the elastomeric chamber 212*a* through the opening 212*b*.

In this embodiment, the vent valve 23 comprises a gas outlet plate 230, a valve membrane 231, a gas collecting plate 232 and a gas exhaust chamber 240. The gas outlet plate 230 comprises an inlet 230*a*, an outlet 230*b*, an inlet buffer chamber 230*c*, an outlet buffer chamber 230*d* and a communication channel 230*e*. A first side of the inlet 230*a* is in communication with the gas-inputting port 221 of the membrane switch circuit layer 22. A second side of the inlet 230*a* is in communication with the inlet buffer chamber 230*c*. A first side of the outlet 230*b* is in communication with the gas-outputting port 222 of the membrane switch circuit layer 22. A second side of the outlet 230*b* is in communication with the outlet buffer chamber 230*d*. The inlet buffer chamber 230*c* and the outlet buffer chamber 230*d* are used for temporarily storing the gas. The communication channel 230*e* is in communication between the inlet buffer chamber 230*c* and the outlet buffer chamber 230*d* to link a passage in which the gas is allowed to pass.

The gas outlet plate 230 further comprises a raised structure 230*f* at the end of the outlet 230*b*. Preferably but not exclusively, the raised structure 230*f* is a cylindrical post. The valve membrane 231 has a valve opening 231*a* aligned with the inlet 230*a* and the inlet buffer chamber 230*c*. The gas collecting plate 232 has a first perforation 232*a* and a second perforation 232*b*. The first ends of the first perforation 232*a* and the second perforation 232*b* are in communication with the gas exhaust chamber 240. The second ends of the first perforation 232*a* and the second perforation 232*b* are in communication with the inlet buffer chamber 230*c* and the outlet buffer chamber 230*d*, respectively. Moreover, the gas collecting plate 232 has a raised structure 232*c* protruding beside the first perforation 232*a*. Preferably but not exclusively, the raised structure 232*c* is a cylindrical post. The raised structure 232*c* is aligned with the valve opening 231*a* of the valve membrane 231. After being assembled, the raised structure 232*d* is aligned with the valve opening 231*a* of the valve membrane 231 so as to form a one-way passage through the valve opening 231*a*, in which the gas is allowed to flow in one way when there is a pressure difference.

As mentioned above, the vent valve 23 comprises the gas exhaust chamber 240. Similarly, the vent valve 23' comprises a gas exhaust chamber 240', and the vent valve 23" comprises a gas exhaust chamber 240". All of the gas exhaust chambers 240, 240' and 240" are in communication with each other. Moreover, the gas exhaust chamber 240, 240' and 240" are in communication with the pump 24. It is noted that the serial connection between the vent valves and the pump may be varied according to the practical requirements.

The operations of the liftable keyboard will be illustrated with reference to FIGS. 4A and 4B. The pump 24 shown in FIG. 4A is not actuated. In this circumstance, the gas in the atmosphere is introduced into the vent valve 23 through the gas exhaust chamber 240. Secondly, the gas is introduced into the inlet buffer chamber 230*c* and the outlet buffer chamber 230*d* through the first perforation 232*a* and the second perforation 232*b* respectively. Since the gas is continuously fed into the vent valve 23 through the gas exhaust chamber 240, a pressure difference is generated to push the valve membrane 231 upwardly. Consequently, the valve opening 231*a* of the valve membrane 231 is opened. Meanwhile, the gas is introduced into the inlet buffer chamber 230*c* through the valve opening 231*a*. Thus, the gas is transferred to the elastomeric chamber 212*a* of the elastomer 212 through the inlet 230*a* and the gas-inputting port 221 of the membrane switch circuit layer 22. Consequently, an initial shape of the elastomer 212 is maintained so as to make the scissor connecting element 211 supporting the keycap 210 in an initial position. At this moment, the keycap 21 has a higher altitude for being pressed by user. At the same time, the valve membrane 231 is subjected to upward deformation, and the top surface of the valve membrane 231 is in close contact with the raised structure 230*f* of the gas outlet plate 230 to close the outlet 230*b*. Since the gas in the vent valve 23 is not able to pass the outlet 230*b* to reach the gas-outputting port 222 of the membrane switch circuit layer 22, the gas in the gas exhaust chamber 240 of the vent valve 23 cannot be exhausted to the surroundings then.

Once the pump 24 receives the electromagnetic signal from the sensing element 2*b*1, the pump 24 is enabled. Please refer to FIG. 4B which shows the flowing direction of the gas. After the pump 24 is enabled, the pump 24 applies suction to the gas exhaust chambers 240, 240' and 240" of the vent valve 23, 23' and 23", consequently generating a pressure difference in the joint space consists of the gas exhaust chambers 240, 240' and 240". In response to the pressure difference, a gas stored in the elastomer 212 is extracted to the gas exhaust chamber 240, through the first perforation 232*a* and the second perforation 232*b* of the gas collecting plate 232. Meanwhile, the valve membrane 231 is moved downwardly and its bottom surface is in close contact with the raised structure 232*c*. As a result, the valve opening 231*a* is closed. Consequently, the gas in the inlet buffer chamber 230*c* is not returned back. Furthermore, the downward valve membrane 231 makes the outlet 230*b* of the gas outlet plate 230 in communication with the outlet buffer chamber 230*d*. Thus, the outlet buffer chamber 230*d* is in communication with the exterior surroundings through the gas-outputting port 222 of the membrane switch circuit layer 22. Consequently, the gas in the elastomeric chamber 212*a* of the elastomer 212 is introduced into the inlet buffer chamber 230*c* through the inlet 230*a* of the gas outlet plate 230, transferred to the outlet buffer chamber 230*d* through the communication channel 230*e*, and outputted to the exterior surroundings through the outlet 230*b* of the gas outlet plate 230 and the gas-outputting port 222 of the membrane switch circuit layer 22.

In the above descriptions, only the key unit 21, the membrane switch circuit layer 22 and the vent valve 23 are emphasized. It is noted that the gas in the vent valves 23, 23' and 23" is transferred to the pump 24 through the gas exhaust chambers 240, 240' and 240", which are in communication with each other. In other words, the pump 24 performs the gas-extracting action to extract the gas from the vent valves 23, 23' and 23" simultaneously. In response to the gas-extracting action of the pump 24, the gas in the elastomeric chambers of all key unit is extracted and the elastomers are subjected to the compressed deformation. As the keycap of each key unit is moved downwardly by a displacement h, the altitude of the key unit is reduced. Since the altitude of the liftable keyboard 20 is reduced, the overall thickness of the portable electronic device 2 is lessened. In other words, the portable electronic device 2 has the benefits of small size, light weightiness and easy portability.

From the above descriptions, the present invention provides a liftable keyboard. The liftable keyboard is applied to a portable electronic device. The liftable keyboard cooperates with a sensing element in the base. The liftable keyboard includes plural key units, a membrane switch circuit layer, plural vent valves and a pump. When the top cover is rotated to cover the base, the sensing element generates an electromagnetic signal. In response to the electromagnetic signal, the pump is enabled. Consequently, the pump applies suction to the gas exhaust chambers of the vent valves such that the gas in the elastomeric chambers of the key units is extracted. When the gas in the elastomeric chamber is extracted, the elastomer is subjected to the compressed deformation so as to descend the keycap. Thus, the altitude of the key units is automatically reduced and the overall thickness of the liftable keyboard is decreased. Consequently, the portable electronic device can be designed to have lessened overall thickness. In other words, the portable electronic device has the benefits of small size, light weightiness and easy portability. As mentioned above, the liftable keyboard of the present invention is capable of automatically detecting the approaching condition of the top cover and reducing the altitude of the liftable keyboard. Therefore, the present invention has the significant advantage of reducing the overall volume of the applied product that making the portable electronic devices slim and easy to carry.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A liftable keyboard for a portable electronic device having a top cover and a base with a sensing element, the liftable keyboard comprising:

a plurality of key units, each of which comprises a keycap and an elastomer aligned with the keycap;

a membrane switch circuit layer comprising a plurality of gas-inputting ports and a plurality of gas-outputting ports, wherein each of the gas-inputting ports is aligned with the elastomer of the corresponding key unit;

a plurality of vent valves, each of which is located under the membrane switch circuit layer and aligned with the corresponding key unit, wherein each of the vent valves comprises an inlet, an outlet and a gas exhaust chamber, wherein the inlet is in communication with the corresponding gas-inputting port of the membrane switch circuit layer, and the outlet is in communication with the corresponding gas-outputting port of the membrane switch circuit layer, and wherein each of the gas exhaust chambers of the vent valves is in communication with the gas exhaust chamber of the at least one adjacent vent valve; and a pump in communication with the gas exhaust chambers of the vent valves, wherein when the sensing element within the base of the portable electronic device senses that the top cover is close to the base, the pump is enabled to apply suction to the gas exhaust chambers of the vent valves such that a gas in the elastomer of each key unit is extracted to the gas exhaust chamber of the corresponding vent valve, sequentially passing through the corresponding gas-inputting port of the membrane switch circuit layer and the inlet of the corresponding vent valve, after which the gas is outputted from the outlet of the corresponding vent valve and discharged from the corresponding gas-outputting port of the membrane switch circuit layer, so that the elastomer of each key unit is subjected to compressed deformation and the keycap of each key unit is moved downwardly in response to the compressed deformation of the elastomer, so as to reduce an altitude of each key unit.

2. The liftable keyboard according to claim 1, wherein each key unit further comprises a scissor connecting element connected to the keycap and connected to the elastomer, the scissor connecting element is adapted to support and move the keycap.

3. The liftable keyboard according to claim 1, wherein each of the vent valve further comprises:

a gas outlet plate comprising:

an inlet buffer chamber;

the inlet, a first side of which is in communication with the corresponding gas-inputting port of the membrane switch circuit layer, and a second side of which is in communication with the corresponding inlet buffer chamber;

an outlet buffer chamber;

the outlet, a first side of which is in communication with the corresponding gas-outputting port of the membrane switch circuit layer, and a second side of which is in communication with the corresponding outlet buffer chamber; and a communication channel in communication between the inlet buffer chamber and the outlet buffer chamber;

a gas collecting plate located under the gas outlet plate; and a valve membrane arranged between the gas outlet plate and the gas collecting plate, and having a valve opening, wherein when the sensing element within the base of the portable electronic device senses that the top cover is close to the base, the pump is enabled to apply suction to the gas exhaust chambers of the vent vales such that the gas is extracted from the inlet to the outlet, sequentially passing through the inlet buffer chamber, the communication channel and the outlet buffer chamber, after which the gas is outputted from the outlet of the corresponding vent valve and discharged from the corresponding gas-outputting port of the membrane switch circuit layer.

4. The liftable keyboard according to claim 3, wherein the gas collecting plate further comprises a first perforation and a second perforation, wherein a first end of the first perforation is in communication with the gas exhaust chamber, and a second end of the first perforation is in communication with the inlet buffer chamber, wherein a first end of the second perforation is in communication with the gas exhaust chamber, and a second end of the second perforation is in communication with the outlet buffer chamber.

5. The liftable keyboard according to claim 4, wherein the vent valve further comprises plural raised structures, wherein a first raised structure of the plural raised structures is located at an end of the outlet, and a second raised structure of the plural raised structures is located beside the first perforation.

6. The liftable keyboard according to claim 1, wherein the sensing element is an electromagnetic sensor, and the top cover further comprises a magnetic element, wherein when the magnetic element is within a sensible distance of the electromagnetic sensor, the electromagnetic sensor generates an electromagnetic signal.

* * * * *